US005140898A

United States Patent [19]

Igarashi

[11] Patent Number: 5,140,898

[45] Date of Patent: Aug. 25, 1992

[54] STENCIL DUPLICATOR CAPABLE OF IMMEDIATE RESTART

[75] Inventor: Tadayuki Igarashi, Urawa, Japan

[73] Assignee: Riso Kagku Corporation, Tokyo, Japan

[21] Appl. No.: 619,911

[22] Filed: Nov. 30, 1990

[30] Foreign Application Priority Data

Dec. 4, 1989 [JP] Japan ..... 1-315059

[51] Int. Cl.[5] ..... B41L 13/06

[52] U.S. Cl. ..... 101/120; 101/128.4

[58] Field of Search ..... 101/116, 117, 118, 119, 101/120, 128.21, 128.4

[56] References Cited

U.S. PATENT DOCUMENTS 4,628,813 12/1986 Hasegawa et al. ..... 101/116

FOREIGN PATENT DOCUMENTS 1263785 3/1968 Fed. Rep. of Germany .
2439091 5/1980 France .
917761 2/1963 United Kingdom .
2208279 3/1989 United Kingdom .

OTHER PUBLICATIONS

Patent Abstract of Japan, M-916, Jan. 9, 1990, Vol. 14, No. 6 (Appl. No. 63-82537)

*Primary Examiner*—Clifford D. Crowder

*Attorney, Agent, or Firm*—Dickstein, Shapiro & Morin

[57] ABSTRACT

Stencil duplicator comprising a stencil master plate processing unit for perforating a stencil master plate according to a desired print pattern, a printing drum unit including a rotary cylindrical printing drum for wrapping a processed stencil master plate therearound and retaining it thereon, and rollers for supplying ink from its inner circumferential surface and through said processed stencil master plate; a press roller unit for pressing a sheet of printing paper against an outer circumferential surface of said printing drum with said processed stencil master plate interposed therebetween. In order to obtain a satisfactory printing result from the first copy even after the stencil duplicator has been kept unused for an extended period of time, the control unit of the stencil duplicator is provided with the mode of operating the duplicator by using a blank stencil master plate and pressing thereon against the printing drum with the press roller unit without supplying printing paper thereto so that the depletion of ink at the printing drum may be avoided. This special printing mode should be started every time a new printing operation is to be started after the duplicator has been kept unused for more than a certain prescribed time period.

3 Claims, 4 Drawing Sheets 15
150
151
151a
151b
S
153
153a
153b
152
152a
152b
16
17
171
172
170
110
11
111
111a
111b
111c
A
133
134
131
132
120
121
12
13
130
P
14
140
141
142
143

START
STENCIL START KEY OR AUTO KEY PRESSED ?
NO
STEP 100
YES
SPECIAL MODE KEY PRESSED ?
NO
STEP 101
YES
STOP TIMER COUNT
STEP 102
T1 > T ?
STEP 103
YES
STEP 104
EJECT STENCIL
FEED BLANK STENCIL
STEP 105
CLAMPING
STEP 106
WRAPPING
STEP 107
PRESSING
STEP 108
N TIMES ?
NO
STEP 109
YES
EJECT STENCIL
STEP 110
NORMAL PRINTING
STEP 111
PRESS ROLLER COUNTER RESET
STEP 112
END

STENCIL DUPLICATOR CAPABLE OF IMMEDIATE RESTART

TECHNICAL FIELD

The present invention relates to a stencil duplicator which can immediately start printing in a satisfactory manner even after the stencil duplicator has kept been unused for an extended period of time.

BACKGROUND OF THE INVENTION

Conventionally, in a stencil duplicator such as the one disclosed in U.S. Pat. No. 4,628,813 issued Dec. 16, 1986 to Hasegawa et al and assigned to the common assignee, in which a stencil master plate processed in a stencil master plate making unit of a stencil duplicator main body is wrapped around a printing drum unit, and printing paper fed from a paper feed unit is pressed against the printing drum unit via a press roller unit, when the stencil duplicator main body begins a new printing operation after it has been kept unused for a certain period of time, the following problem may arise.

Specifically, before a satisfactory printing operation is made possible so that the entire image may be evenly printed over the entire printing paper by the newly processed stencil master plate wrapped around the printing drum unit, a substantial number of sheets of defectively printed paper are required to be rejected, thereby increasing the printing cost and extending the time required for the printing operation.

This is due to the facts that the ink existing in the printing drum unit and between the printing drum unit and the stencil master plate is dried up, thereby depriving the ink that is required for satisfactory printing; and that the stencil master plate used for the previous printing operation is removed and discarded with a significant amount of ink attached thereto before a newly processed stencil master plate is wrapped around the printing drum unit.

BRIEF SUMMARY OF THE INVENTION

In view of such problems of the prior art, a primary object of the present invention is to provide a stencil duplicator which is reliable and free from the disadvantage of making defective prints.

A second object of the present invention is to provide a stencil duplicator which can satisfactorily print from the first sheet of printing paper without wasting a sheet of printing paper when a new printing operating is started even after the stencil duplicator has been kept unused for an extended period of time.

To achieve such an object, the present invention consists of a stencil duplicator, comprising: a stencil master plate processing unit for perforating a stencil master plate according to a desired print pattern; stencil master plate feed means for supplying a blank stencil master plate to the stencil master plate processing unit at a time; a printing drum unit including a rotary cylindrical and porous printing drum, means for wrapping the processed stencil master plate therearound and retaining the stencil master plate thereon, and means for supplying ink from its inner circumferential surface and through the processed stencil master plate; a press roller unit for pressing a sheet of printing paper against an outer circumferential surface of the printing drum with the processed stencil master plate interposed therebetween; means for supplying printing paper to the press roller unit one sheet at a time; means for removing the stencil master plate from the outer circumferential surface of the printing drum; means for ejecting the printing paper upon completion of a printing process for each sheet of printing paper; and control means for controlling the operation of the stencil master plate processing unit, the stencil master plate feed means, the printing drum unit, the press roller unit, the printing paper supplying means, the stencil master plate removing means, and the printing paper ejecting means; the control means further comprising means for setting up, in addition to a normal printing mode, a mode for carrying out a blank printing mode in which an unprocessed stencil master plate is wrapped around the printing drum and the press roller unit is pressed upon the unprocessed master plate against the printing drum for a prescribed number of times without feeding printing paper therebetween.

According to the stencil duplicator of the present invention, since there is provided a blank printing mode for producing a command so as to wrap an unprocessed stencil master plate supplied from the plate making unit around the printing drum unit, to prohibit feeding of printing paper from the paper feed unit, and to press the press roller unit against the printing drum unit around which the unprocessed stencil master plate is wrapped for a prescribed number of times, when starting a new duplication process consisting of processing or perforating a stencil master plate and making prints by using this stencil master plate, a sufficient amount of ink is fed to the printing drum unit and between the printing drum unit and the new stencil master plate, and a satisfactory and uniform printing of the entire image is possible from the first sheet of printing paper.

Since this blank printing mode is desired to be selected particularly when the duplicator has been kept unused for an extended period of time, it is preferred that the control means further comprises timer means for measuring a time period starting from the end of a previous printing operation, the control means starting the blank printing mode when a new printing process is started after the time period measured by the timer means has exceeded a prescribed time period.

Since the supply of ink between the printing drum and the stencil master plate is more abundant as the printing speed is reduce, the printing drum is desired to be rotated at a speed corresponding to a relatively low printing speed.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
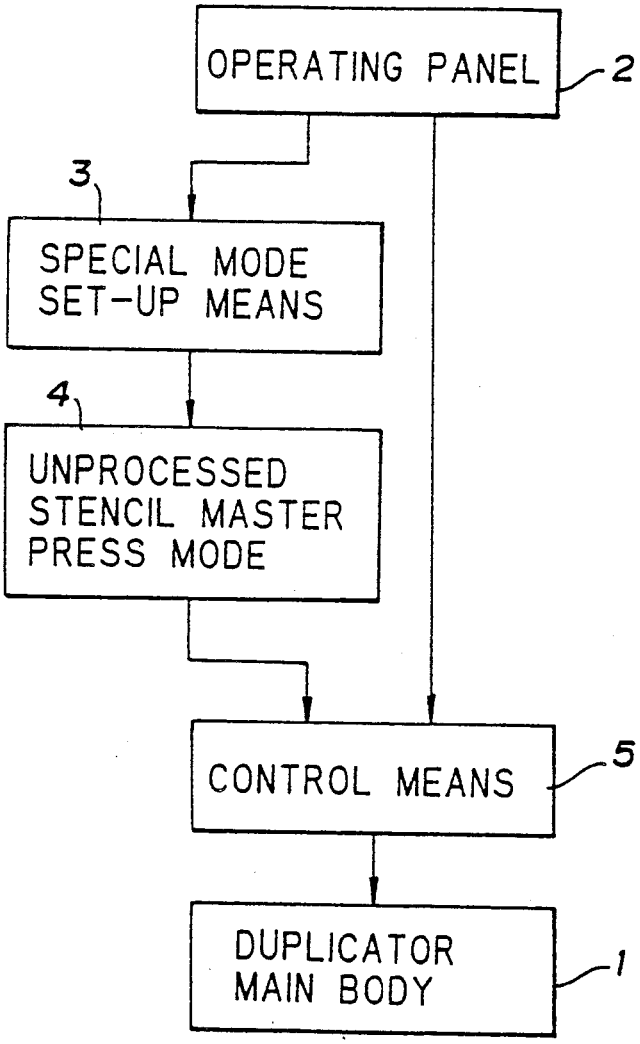
FIG. 1 is an illustrative view of the overall structure of the stencil duplicator according to the present invention.
Figure 2:
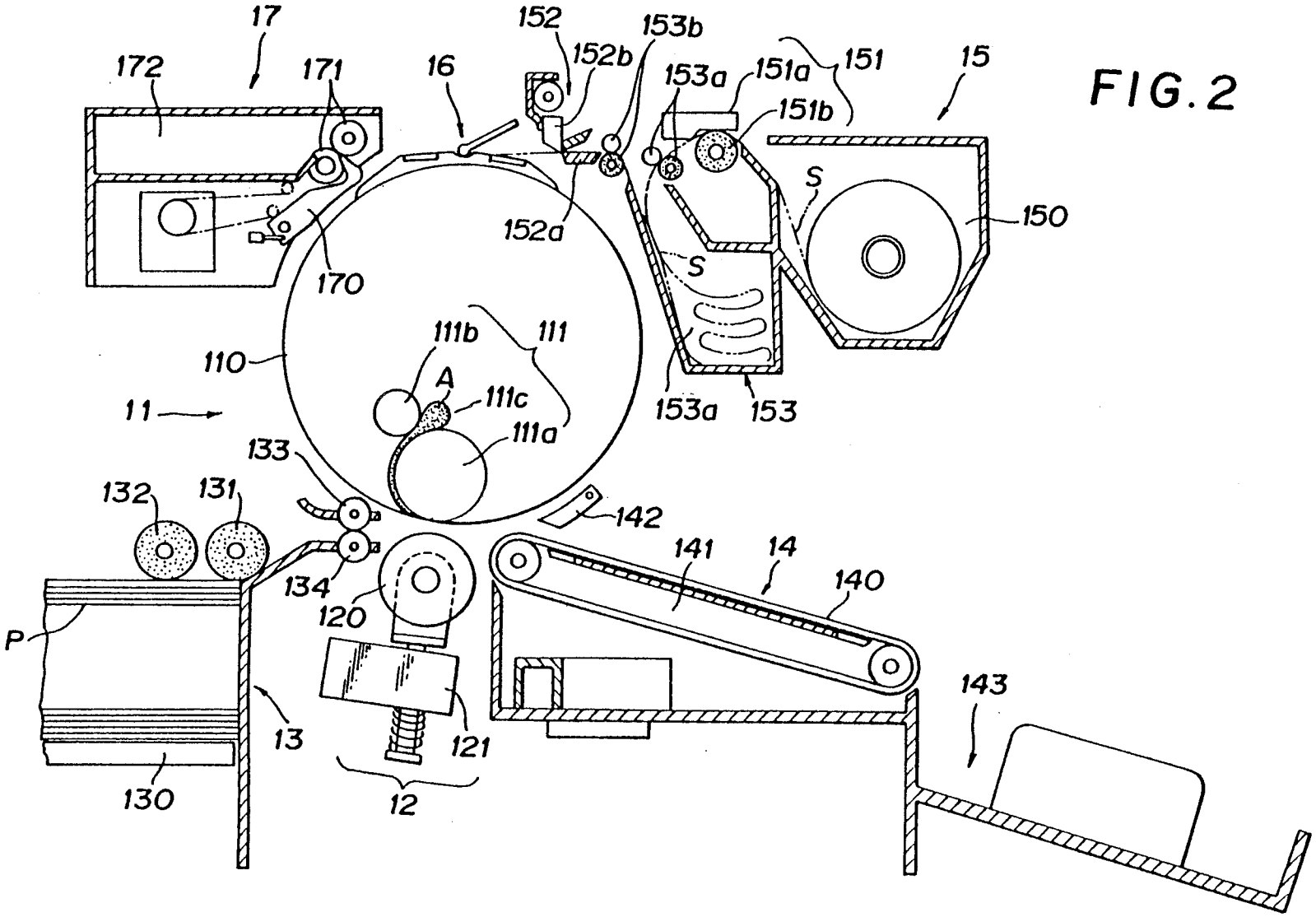
FIG. 2 is an illustrative sectional view showing the structure of the stencil duplicator main body.

FIG. 1 is an illustrative view of the overall structure of the stencil duplicator according to the present invention, and FIG. 2 is an illustrative sectional view of the stencil duplicator main body.

As shown in these drawings, this stencil duplicator consists of a stencil duplicator main body 1, an operating panel 2, specific mode set up means 3, unprocessed master plate press mode set up means 4, and control means 5.

As shown in FIG. 2, the stencil duplicator main body 1 consists of a printing drum unit 11, a press roller unit 12, a paper feed unit 13, a paper eject unit 14, a stencil master plate making unit 15, a clamp unit 16, and a stencil master plate eject unit 17.

The printing drum unit 11 is provided with a printing drum 110 consisting of a porous cylinder and rotatably supported by a printing drum drive mechanism not shown in the drawings, and an ink supply mechanism 111 consisting of a squeegee rotor 111*a* which rotates with the printing drum 110 by engaging the inner circumferential surface of the printing drum, a doctor rod 111*b* opposing the outer circumferential surface of the squeegee rotor 111*a* defining a certain gap therebetween, and an ink reservoir 111*c* therebetween.

Thus, when the printing drum 110 is rotated in counter-clockwise direction in the drawing, the squeegee rotor 111*a* also rotates in the same direction as the printing drum 110 in synchronism therewith, and printing ink A in the ink reservoir 111*c* is supplied to the inner circumferential surface of the printing drum 110.

The press roller unit 12 is provided below the printing drum 110, and a press roller 120 is selectively urged toward the outer circumferential surface of the printing drum 110 by the electromagnetic force of a press solenoid 121.

The paper feed unit 13 is provided on one side of the press roller unit 12, and a plurality of sheets of printing paper P are stacked on a paper feed table 130 of the paper feed unit 13. The upper most sheet of the stack of printing paper is taken out one by one by a paper separation roller 131 and a paper feed roller 132, and is fed between the printing drum 110 and the press roller 120 by a timing roller 133 and a guide roller 134.

Thus, the printing ink A is passed through the apertures in the stencil master plate S wrapped around the outer circumferential surface of the printing drum 110 as the printing paper P passes between these two rollers 110 and 120, and a printed image is formed on the printing paper P.

The paper eject unit 14 is provided on the other side of the press roller unit 12, and is provided with a belt conveyor 140 and a suction box 141. The printed printing paper P is removed from the printing drum 110 by a separation claw 142, and is secured to the suction box 141 by suction until it is conveyed to a paper eject table 143.

The plate making unit 15 is disposed above the printing drum 110 on one side thereof, and is provided with a master plate storage unit 150 for storing a roll of stencil master plate in the form of a continuous sheet. A stencil master plate making mechanism 151 is disposed between the master plate storage unit 150 and the printing drum 110.

The plate making mechanism 151 is provided with a thermal head 151*a* and a platen roller 151*b*, and thermally processes the stencil master plate S supplied from the master plate storage unit 150.

A master plate cutting mechanism 152 having a fixed blade 152*a* and a movable blade 152*b* is provided between the plate making mechanism 151 and the printing drum 110, and cuts off the stencil master plate S with the fixed and moveable blades 152*a* and 152*b*.

A master plate stock mechanism 153, provided between the plate making mechanism 151 and the master plate cutting mechanism 152, consists of a box-shaped master plate stock unit 153*a* for storing a meandering length of master plate S corresponding to a certain number of sheets of master plate S, a master plate feed roller 153*b* for feeding the master plate S from the plate making mechanism 151 to the master plate stock unit 153*a*, and a master plate take out roller 153*c* for forwarding the stencil master plate S from the master plate stock unit 153*a* to the master plate cutting mechanism 152.

The plate eject unit 17 is provided above the printing drum 110 on the opposite side, and consists of a moveable master plate removal claw 170, a plate making roller 171, and a plate eject box 172.

Numeral 16 denotes the clamp unit for engaging an end of the stencil master plate S wrapped around the outer circumferential surface of the printing drum 110.

Figure 3:
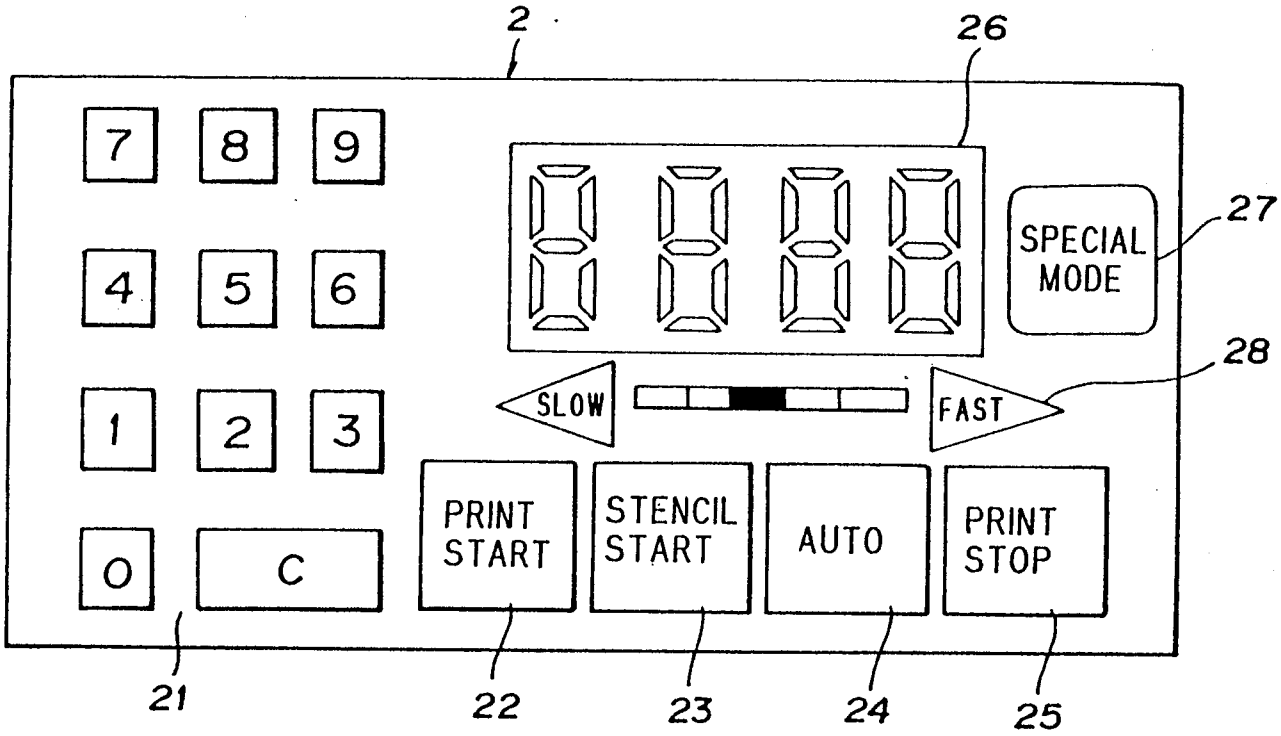
FIG. 3 is a plan view showing an example of the operating panel of this duplicator.

As shown in FIG. 3, the operating panel 2 is provided with a ten-key pad 21 for entering the desired number of copies, a print start key 22, a plate making start key 23, a plate making/printing auto key 24 for automatically carrying out a series of steps from stencil master plate making to printing, a print stop key 25, a print speed set up key 28, and an LCD display unit 26 for indicating information such as the desired number of copies.

This operating panel 2 is further provided with a special mode set up key 27 for activating the mode set up means to the end of activating the unprocessed master plate press mode set up means 4 which is described hereinafter.

Upon reception of a command signal from the mode set up means 3, the unprocessed master plate press mode set up means 4 controls the stencil duplicator main body in the following fashion:

Specifically, the stencil master plate S from the plate making unit 15 in its unprocessed state is wrapped around the printing drum 110, and while the feeding of printing paper P from the paper feed unit 13 is prohibited the press roller 120 is pressed against the printing drum 110 around which the unprocessed stencil master plate S is wrapped a necessary number of times.

The control means 5 normally activates the stencil duplicator main body 1 in a selective fashion according to the various commands from the operating panel 2, and, according to the present invention, is provided with time measuring means for counting the rest time interval between the end of the previous printing operation and the start of the next printing operation (by counting the time interval during which the press roller unit 12 responsible for renewal of each printing operation is not operative in the present embodiment), and comparing means for comparing the time interval data T1 obtained by this time measuring means with a prescribed time data T stored in RAM or the like in advance so that the stencil duplicator main body 1 may be controlled by the unprocessed master plate press mode set up means 4 when a command for a new printing operation is received, and it is determined that the time data T1 is greater than the time data T.

Figure 4:
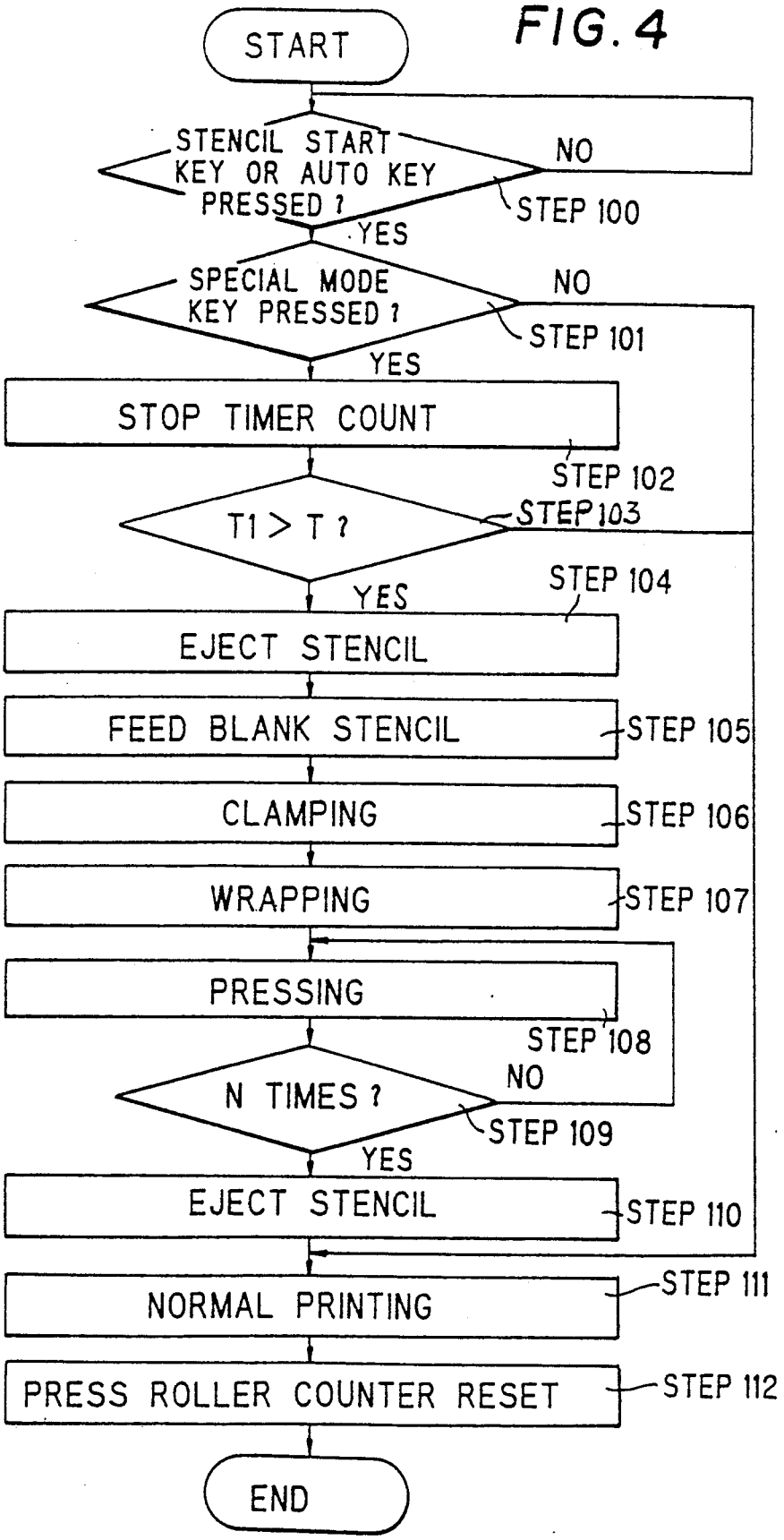
FIG. 4 is a flow chart describing the operation of this stencil duplicator.

Now the operation of the stencil duplicator of the present invention is described in the following with reference to the flow chart of FIG. 4.

First of all, in step 100, it is determined whether the plate making start key 23 or the plate making/printing auto key 24 on the operating panel 2 has been pressed or not. This determination process is continued as long as neither of the keys is pressed, but the program flow advances to step 101 when it is determined that either one of keys has been pressed.

In step 101, it is determined whether the special mode set up key 27 has been pressed or not, and if this key is not pressed the program flow advances to step 111 to immediately start the normal plate making/printing operation.

If it is determined that the special mode set up key 27 has been pressed in this step 101, the program flow advances to step 102 where the operation of the time measuring means of the control means 5 to count the time interval T1 from the end of the previous printing operation is stopped.

Then, the program flow advances to step 103 where the comparison means of the control means 5 compares the measured time interval T1 with the time interval T stored in the RAM and the plate making/printing operation is carried out in step 111 if it is not determined that $T1>T$.

If it is determined that $T1>T$, the program flow advances to step 104, and the stencil master plate used in the previous printing operation and wrapped around the printing drum 110 is removed by the plate eject unit 14.

Then, in step 105, the unprocessed stencil master plate S is supplied from the plate making unit to the printing drum 11. Thereafter, a clamping process is carried out in step 106, and the unprocessed stencil master plate S is securely wrapped around the printing drum 110 in step 107.

In step 108, simultaneously as this plate wrapping process is carried out the press process in which the press roller 120 is pressed against the printing drum 110. In step 109, it is determined whether this press process has been carried out for a prescribed number (N) of times or not.

If it is determined that the press process has not been carried out for the prescribed number of times, the printing drum 110 is drivingly rotated back in step 108, and the press process of pressing the press roller 120 is repeated. If it is determined that the press process has been carried out an N number of times, the unprocessed stencil master plate which was subjected to the N number of times of the press process by the press roller 120 is ejected in step 110.

Thereafter, the normal plate making/printing process is carried out in step 111. Upon completion of this plate making/printing process, the counter of the press roller 120 which was activated during the above mentioned process is reset in step 112, and the entire process is completed.

The printing speed is variable within the range of 60 to 130 sheets per minuet by setting the printing speed set up key 28, and the rotational speed of the printing drum 110 in carrying out the above mentioned press process is set to a value corresponding to a low printing speed range of 10 to 30 sheets per minute because the supply of ink A between the printing drum unit 11 and the stencil master plate S increases as the rotational speed of the printing drum is reduced.

Thus, according to the stencil duplicator of the present invention, since there is provided unprocessed master plate press mode set-up means for producing a command to wrap an unprocessed stencil master plate supplied from the plate making unit around the printing drum unit, to prohibit feeding of printing paper from the paper feed unit, and to press the press roller unit against the printing drum unit around which the unprocessed stencil master plate is wrapped for a prescribed number of times, when a printing operation is to be started after the stencil duplicator has been kept unused for an extended period of time, it is possible to supply a sufficient amount of ink between the printing drum unit and the stencil master plate to carry out a satisfactory printing process.

Therefore, it becomes possible to avoid printing a large number of defective sheets of printed paper, and a uniform printing result can be obtained from the first copy so that the printing cost and the printing time can be both reduced.

Although the present invention has been described in terms of a specific embodiment, it is possible to modify and alter details thereof without departing from the spirit of the present invention.

What we claim is:

1. Stencil duplicator, comprising:

a stencil master plate processing unit for perforating a stencil master plate according to a desired print pattern;

a stencil master plate feed means for supplying a blank stencil master plate to said stencil master plate processing unit at a time;

a printing drum unit including a rotary cylindrical printing drum, means for wrapping said processed stencil master plate therearound and retaining said stencil master plate thereon, and means for supplying ink from its inner circumferential surface and through said processed stencil master plate;

a press roller unit for pressing a sheet of printing paper against an outer circumferential surface of said printing drum, during rotation of said printing drum, with said processed stencil master plate interposed therebetween;

means for supplying printing paper to said press roller unit one sheet at a time;

means for removing said stencil master plate from the outer circumferential surface of said printing drum;

means for ejecting said printing paper upon completion of a printing process for each sheet of said printing paper; and control means for controlling the operation of said stencil master plate processing unit, said stencil master plate feed means, said printing drum unit, said press roller unit, said printing paper suppling means, said stencil master plate removing means, and said printing paper ejecting means;

said control means further comprising means for operating said stencil duplicator, in addition to a normal printing mode, in a blank printing mode in which an unprocessed stencil master plate is wrapped around said printing drum and said press roller unit is pressed upon said unprocessed master plated against said printing drum, during rotation of said print drum, for a prescribed number of times without feeding printing paper therebetween.

2. Stencil duplicator according to claim 1, wherein said control means further comprising timer means for measuring a time period starting from the end of a previous printing operation, said control means starting said blank printing mode when a new printing process is started after said time period measured by said timer means has exceeded a prescribed time period.

3. Stencil duplicator according to claim 1, wherein said printing drum is rotated at a slower speed during said blank printing mode than during said normal printing mode.

* * * * *